US005950608A

United States Patent [19]

Tidman

[11] Patent Number: 5,950,608

[45] **Date of Patent: *Sep. 14, 1999**

[54] METHOD OF AND APPARATUS FOR MOVING A MASS

[75] Inventor: Derek A. Tidman, McLean, Va.

[73] Assignee: Advanced Launch Corporation, McLean, Va.

[ * ] Notice: This patent is subject to a terminal disclaimer.

[21] Appl. No.: 08/996,134

[22] Filed: Dec. 22, 1997

Related U.S. Application Data

[63] Continuation of application No. 08/519,336, Aug. 25, 1995, Pat. No. 5,699,779.

[51] Int. Cl.[6] ..... F41B 3/04

[52] U.S. Cl. ..... 124/6; 124/1; 74/86; 89/8

[58] Field of Search ..... 124/1, 3, 4, 6, 124/81; 74/86, 87; 89/8

[56] References Cited

U.S. PATENT DOCUMENTS

| | | | |
|---|---|---|---|
| 956,244 | 4/1910 | Westerberg . | |
| 2,644,270 | 7/1953 | Marong | 446/170 |
| 2,684,062 | 7/1954 | Rose | 124/6 |
| 3,185,479 | 5/1965 | Ortega | 473/509 |
| 4,238,968 | 12/1980 | Cook | 74/84 R |
| 4,632,086 | 12/1986 | Rutten | 124/6 |
| 4,881,446 | 11/1989 | Marks et al. | 89/8 |
| 4,901,621 | 2/1990 | Tidman | 89/8 |
| 4,942,775 | 7/1990 | Monkewitz et al. | 73/865.3 |
| 4,960,760 | 10/1990 | Wang et al. | 505/164 |
| 5,017,549 | 5/1991 | Robertson | 505/164 |
| 5,105,713 | 4/1992 | Wirgau | 89/8 |
| 5,183,956 | 2/1993 | Rosenberg | 89/8 |
| 5,217,948 | 6/1993 | Leung et al. | 89/8 X |
| 5,253,590 | 10/1993 | Marusak | 104/138.1 |
| 5,294,850 | 3/1994 | Weh et al. | 89/8 X |
| 5,388,470 | 2/1995 | Marsh | 74/84 R |
| 5,699,779 | 12/1997 | Tidman | 124/6 |

FOREIGN PATENT DOCUMENTS

| | | | |
|---|---|---|---|
| 869555 | 2/1942 | France | 124/6 |
| 526908 | 7/1940 | United Kingdom | 124/6 |

OTHER PUBLICATIONS

Tidman, et al "Sling Launch of Materials Into Space," Conference on Space Manufacturing, Space Studies Institute, Princeton, NJ, May 4–7, 1995.

*Primary Examiner*—John A. Ricci
*Attorney, Agent, or Firm*—Lowe Hauptman Gopstein Gilman & Berner

[57] ABSTRACT

A mass located in a track defined by a closed, continuous path is gradually and smoothly accelerated or decelerated by controlling movement of the track so a portion of the track where the mass is sensed to be located is moved inwardly (for acceleration) or outwardly (for deceleration) along a local radius of curvature of the track.

23 Claims, 10 Drawing Sheets

METHOD OF AND APPARATUS FOR MOVING A MASS

This application is a continuation application of application Ser. No. 08/519,336 filed Aug. 25, 1995 now U.S. Pat. No. 5,699,799.

FIELD OF INVENTION

The present invention relates generally to a method of and apparatus for moving, preferably accelerating and/or decelerating, a mass located in a track and more particularly to such a method and apparatus wherein movement of the track is controlled so a portion of the track where the mass is determined to be located is moved inwardly (for acceleration) or outwardly (for deceleration) along a local radius of curvature of the track.

BACKGROUND ART

Slings are ancient devices used to launch masses. In a conventional sling, a mass to be launched is located at the end of an arm that is rotated along a circular path. Typically, the arm is made of a flexible material, such as a cord or the like.

The sling would be an effective device for accelerating masses to hypervelocities if the sling could be operated in a field-free vacuum with a long mythical cord of infinite tensile strength and small mass density. It would also be advantageous if a mass being accelerated by the sling could encounter minimum friction as in a field-free vacuum and out of contact with a track.

While certain toys have been developed base on sling principles, they are not suitable for accelerating a large mass to high velocity. For example, a toy in the nature of a hula hoop has been developed wherein a mass is located inside of the hoop and functions as a noisemaking device. As the hoop is whirled about the midsection of a human, the mass moves in a trajectory similar to the trajectory of a mass propelled by a sling. Other toys and games operating on these principles are disclosed by Ortega, U.S. Pat. No. 3,185,479, Marong U.S. Pat. No. 2,644,270 and Westerberg, U.S. Pat. No. 956,244. In all these devices, a mass, in the form of a sphere, is located in a circular track that is moved to propel the mass about the track. However, the developers of these devices apparently did not realize the possibility of the use of the principles employed in the devices to accelerate a mass that could range from grams to tons to a very high velocity.

In a conventional sling, as schematically illustrated in FIG. 1, mass 1 is attached to cord 2, having a length R. The end of cord 2 remote from mass 1 is rotated about a circular path 3 having a radius r, where R>>r and a center point 4. At different times, mass 1 and cord 2 are located at different positions as designated by dotted lines 1' and 2'. At the end of cord 2 remote from circular path 3, mass 1 moves with rotational velocity V in the circular path. Mass 1 traverses a circle of radius $(R^2+r^2)^{1/2}$ at a velocity $(V_{100}{}^2+v^2)^{1/2}\approx V$, where $V_\phi$ is the velocity component of mass 1 perpendicular to cord 2 and V is the velocity of the mass in the circular path it traverses at the end of cord 2. Since r is much less than R, the velocity ratio $V/v\approx R/r$.

The value of V is increased by slowly increasing v while maintaining the phase relationship between mass 1 and the end of cord 2 traversing circular path 3 such that cord 2 remains approximately tangential to the circular path. Work is performed by pulling against the tension of cord 2; the tension on cord 2 is approximately $mV^2/R$, where m is the amount of mass of mass 1. The acceleration $g_{||}=V$ of mass 1 in its circular trajectory is approximately in accordance with:

$$\dot{V} \approx \frac{vV}{R} = \frac{rV^2}{R^2}.$$

Hence, the acceleration of mass 1 around the circular path it is traversing, $g_{||}$, is related to the centrifugal acceleration, $g_\perp$, in accordance with:

$$g_{||}=g_\perp(r/R).$$

Because $g_{||}$ is much less than $g_{\equiv}$, mass 1 can reach a high velocity by applying the acceleration $g_{||}$ for a sufficient length of time. For example, if such a sling were operated in a field-free vacuum using a hypothetical massless cord of high tensile strength, and if the point where cord 2 is connected to path 3 is accelerated slowly to a speed $v_{max}=10$ m/sec around inner circle, 3, and the length of cord 2 and the radius of circle r are such that $R/r=10^3$, then $V_{max}=10$ km/sec. Obviously, such a speed cannot be reached since the tensile strength of cord 2 would be exceeded when mass 1 achieved a speed considerably less than 1 km/sec.

The Invention

I have realized that the prior art devices can be modified to provide a method of and apparatus for gradually and smoothly moving preferably accelerating and/or decelerating, a mass located in a track having a path defined by a closed, continuous smooth path. In accordance with my invention, the position of the mass in the track is determined by sensing the mass and/or from preprogrammed data. Movement of the track is controlled so a portion of the track where the mass is determined to be located is moved radially inwardly (for acceleration) or outwardly (for deceleration) along a local radius of curvature of the track.

In a preferred embodiment, the track is relatively rigid and a portion of the track diametrically opposed from the portion of the track where the mass is located is moved in the opposite sense along its local radius of curvature from the direction the track is moved where the mass is located.

To eject the mass from the track, the trajectory of the track and mass is modified so the tube is displaced. In one embodiment, a portion of the track is displaced to have a curvature less than the curvature of the portion of the usual track path. In another embodiment, the trajectory of a portion of the track is modified so that the mass is ejected from the track in a direction having a component at right angles to a plane including the normal circular track it is traversing.

In the preferred embodiment of the invention, the mass is moved in a track having considerably lower than atmospheric pressure to provide a path having low coefficient of friction for the mass traversing the path. The low friction coefficient of the path is preferably augmented by levitating the mass magnetically so that as the mass moves in the track the mass is removed from any mechanical surfaces associated with the track.

In a preferred embodiment, the track is moved by a drive mechanism including a rotating shaft. The speed of the shaft is monotonically changed as the total time spent by the mass moving around the path increases. For acceleration, the speed of the rotating shaft increases monotonically as the operating time of the device progresses; to decelerate the mass, the shaft speed is decreased. In a preferred embodiment, plural rotating shafts distributed about the track are provided and monotonically changed in speed.

The invention has application to accelerating a mass that could range from grams to thousand of kilograms. The invention has particular application to accelerating a mass having a mass value in excess of 1,000 kilograms. In a preferred embodiment, such a mass is slowly accelerated in a closed evacuated guide tube around a circular path of large radius R to a very high velocity V, such as several km/sec., without the use of electric pulse power technology.

The mass is accelerated by a coriolis force that is generated by driving a smooth low speed circular displacement motion of the evacuated guide tube by rotary drive machinery distributed around the circular path. The rotary drive machinery includes synchronized drive rotors that are phased relative to the mass location in response to sensors for the position of the mass around the track. The rotors continuously pull the guide tube, which is preferably circular, inwardly along its radius where the mass is located, i.e., the tube is moved inwardly along its local radius of curvature. The dynamics of the process is similar to that of a conventional sling, but without the cord tensile strength problem that limits conventional slings to accelerating masses to well below 1 km/sec.

The rotary shafts supply a relatively small power to accelerate the guide tube and mass. However, by applying the power to the guide tube and mass over a time interval ranging from seconds to many tens of minutes, the mass can reach an extremely high velocity. Because the power levels are low relative to guns they can be provided by conventional drive motors energized by fossil fuel or electricity. The diameter of the circular path of the guide tube can range from less than a meter to many kilometers depending on the desired velocity of the mass to be accelerated, as well as the magnitude of the mass.

It is, accordingly, an object of the present invention to provide a new and improved method of and apparatus for moving, preferably accelerating, a mass, particularly a heavy mass, at or to high velocities.

Another object of the invention is to provide a new and improved method of and apparatus for decelerating masses.

An additional object of the invention is to provide a new and improved method of and apparatus for moving, preferably accelerating and decelerating, masses by use of principles similar to those used in a sling, but without using a cord that is attached to the mass.

An additional object of the invention is to provide a new and improved method of and apparatus for accelerating a large mass to a high velocity without the need for a large source of electrical pulsed power.

An additional object of the invention is to provide a new and improved method of and apparatus for accelerating and/or decelerating a mass by gradually and smoothly accelerating and/or decelerating the mass along a track defined by a closed, continuous smooth path.

A further object of the invention is to provide a new and improved method of and apparatus for accelerating a large mass to high velocity by using relatively low power sources compared with those required by electrically powered guns.

An additional object of the invention is to provide a new and improved method of and apparatus for accelerating a mass that could range from grams to tons to a velocity in excess of 10 km/sec using conventional rotary power sources, such as internal combustion engines or electric motors.

The above and still further objects, features and advantages of the present invention will become apparent upon consideration of the following detailed descriptions of several specific embodiments thereof, especially when taken in conjunction with the accompanying drawings.

DESCRIPTION OF THE PREFERRED EMBODIMENT

Figure 1:
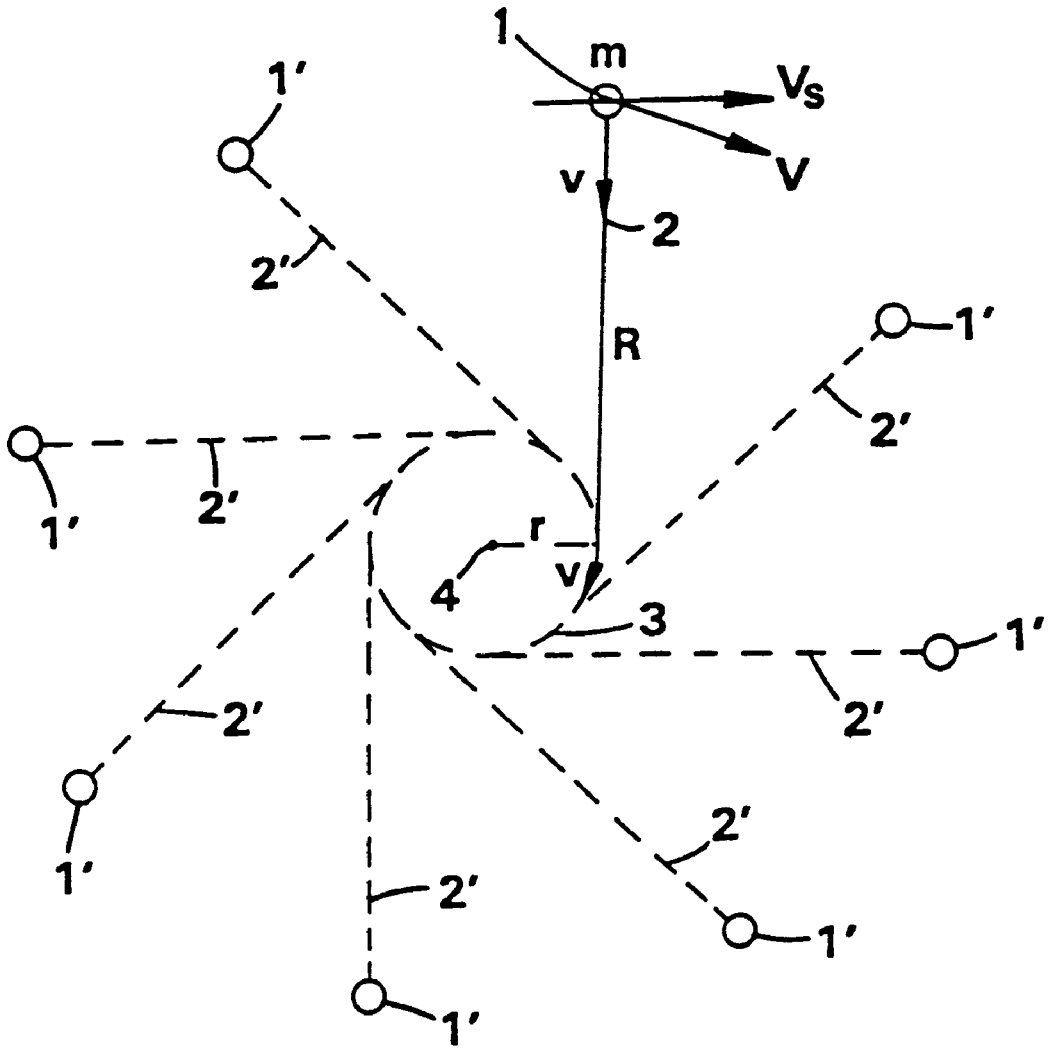
Figure 1 PRIOR ART
FIG. 1, as previously described, is a schematic drawing of a conventional sling for accelerating a mass.
Figure 2:
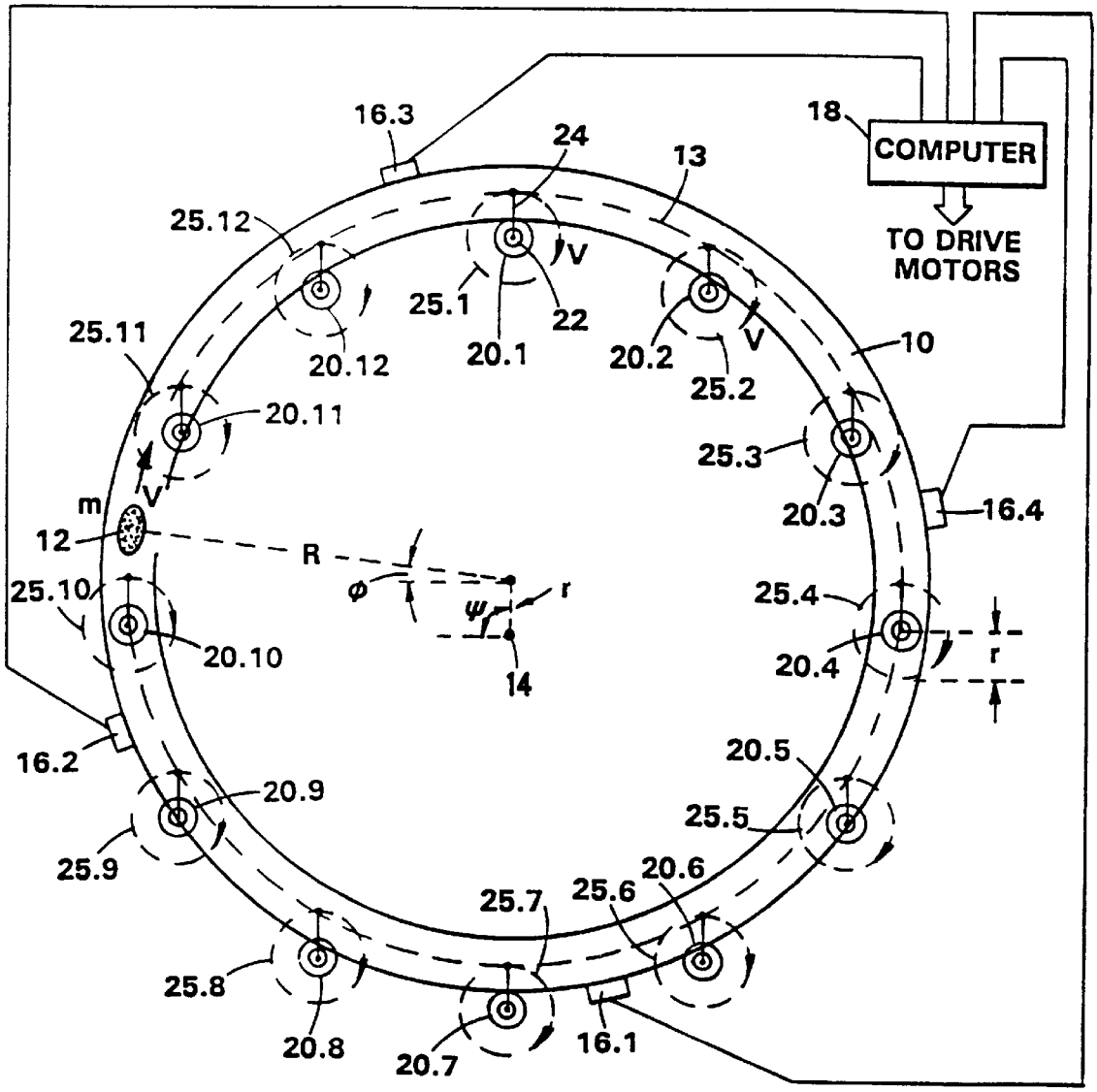
FIG. 2 is a schematic drawing of a device based on the present invention.

Reference is now made to FIG. 2 of the drawing, wherein a sling type device which operates on the same principles as the device illustrated in FIG. 1, but without the requirement for cord 2, is schematically illustrated as including rigid guide tube 10 is which mass or projectile 12 is gradually and smoothly accelerated. Tube 10 can be defined as a track having a closed, continuous, smooth circular path of radius R to the circular center line 13 of tube 10. In essence, tube 10 is a circular hoop surrounding fixed central axis 14, Tube 10 and therefore projectile 12 are moved relative to axis 14 so a portion of the track where mass 12 is located is moved inwardly along a local radius of curvature of the track defined by the tube.

To assist in accomplishing this result, the position of mass 12 in tube 10 is detected by position detectors 16.1–16.4, spaced 90° apart from each other relative to mutually orthogonal radii extending from the center of the circle of center line 13. Detectors 16.1–16.4 can be of any conventional type, such as optical magnetic, capacitive etc., and may be mounted on tube 10 or at fixed locations near the tube. Any suitable number of detectors for the position of mass 12 can be employed and as few as one position detector can be used. Position detectors 16.1–16.4 supply signals to computer 18, which responds to the signals to drive fixedly mounted motors 20.1–20.12, each including a shaft 22. Shafts 22 of motors 20.1–20.12 are equi-angularly spaced about fixed axis 14 so each is spaced 30° apart.

The speeds of shafts 22 are controlled in response to output signals of computer 18 to control the movement of guide tube 10 so that the portion of the guide tube where mass 12 is located is moved inwardly along a local radius of curvature of the track defined by the guide tube, approximately toward axis 14. In the preferred embodiment, described infra, mass 12 is levitated away from the walls of tube 10 and located in a low pressure environment within tube 10 to provide a low friction path for the mass in the interior of the tube.

The rotary shaft 22 of each of motors 20.1–20.12 has an axis parallel to axis 14 and a crank 24 fixedly connected to it. An end of each crank 24 remote from each shaft 22 is fixedly connected to a different portion of circular center line 13 of guide tube 10 such that the connection points are spaced approximately equal-angularly (i.e. 360°/12 =30° apart). The distance between shaft 22 and the connection point of crank 24 to circle 13 on guide tube 10 is r. Each of shafts 22 is spaced from axis 14 by a distance R and is equi-angularly spaced about a circle of radius R so the angular separation between shafts 22 is 30°. The motions of the ends of cranks 24 of motors 20.1–20.12 connected to circle 13 are respectively illustrated in FIG. 2 by dotted circles 25.1–25.12.

Motors 20.1–20.12, shafts 22 and cranks 24 drive rigid guide tube 10 with an eccentric motion such that the path of the end of radius R of circle 13 remote from tube 10 is a circle having radius r about axis 14. Hence, at one particular instant of time, the portions of circular center line 13 of tube 10 connected to the ends of cranks 24 driven by diametrically opposed motors 20.1 and 20.7 are respectively spaced from axis 14 by (R+r) and (R−r); one-half cycle of the motion of mass 12 later, the portions of line 13 connected to the cranks driven by motors 20.1 and 20.7 are respectively spaced from axis 14 by (R−r) and (R+r). At both of these instants, the portions of center line 13 connected to the cranks driven by motors 20.4 and 20.10 are spaced from axis 14 by a distance that closely approximates R. For the situation illustrated in FIG. 2 wherein the ends of cranks 24 respectively driven by motors 20.1, 20.4, 20.7 and 20.10 are spaced from axis 14 by (R+r), R, (R−r), and R, mass 12 is located on center line 13 approximately one-half of the arcuate distance from the ends of the cranks driven by motors 20.8 and 20.12 to satisfy the requirement for the track, defined by center line 13, to be moved inwardly along the local radius of the track curvature where mass 12 is sensed to be located.

Tube 10 is thus moved in its entirety so all points around the circumference of the tube synchronously traverse a small circle having a displacement radius r at a low monotonically increasing rotational speed v(t). A displacement wave thus propagates around guide tube 10 with speed $$\frac{Rv}{r}.$$

As mass 12 advances around the track defined by guide tube 10 with speed V, a reaction force from the track defined by the tube replaces the confining tensile force of cord 2, FIG. 1. By increasing the rotational velocity v(t) of shaft 22 of each of motors 20.1–20.12 monotonically at the correct rate, determined by the detected position of mass 12, an accelerating force proportional to the mass of mass 12 is produced; the accelerating force is equivalent to the mass sliding down an inclined surface having a small angle proportional to r/R in a gravitational field of acceleration strength $V^2/R$. Because of the high wave speed $$\frac{Rv}{r},$$

the accelerating force has no problem keeping up with the motion of mass 12.

Each point around tube 10 experiences a series of brief high pressure pulses as that point is repeatedly traversed by mass 12. The average centrifugal force of mass 12 is contained by a combination of tension in guide tube 10 and the distributed shafts of motors 20.1–20.12 to which the tube is fixedly attached. The average tension in the material of guide tube 10 of material cross sectional area $A_t$ can be estimated (neglecting the support forces of crank arms 24) as the force required to hold a section of tube 10 of length πR in place while that tube section reverses the momentum mV of mass 12 in a half cycle time $$\frac{\pi R}{V},$$

which results in an estimated tensile stress $T=mV^2/(R\pi A_t)$. This stress can be supported by a guide tube with a wall having a moderate thickness.

A significant amount of momentum resides in the low speed motion of guide tube 10 because of its large mass, $M_{tube}$. However, the kinetic energy of mass 12 usually exceeds that of the tube since $(mV^2)/(M_{tube}V^2)\sim(mR^2)/(r^2M_{tube})$ and R/r is much greater than 1. The work done by motors 20.1–20.12 in driving tube 10 flows efficiently into mass 12 with little energy being stored in the tube.

It can be shown that the acceleration of mass 12 around tube 10 for optimum phasing for acceleration of mass 12 due to the rotation of crank arms 24 can be represented by:

$$g_1 = g_\perp\left(\frac{r}{R} - \alpha\right)$$

where $$\alpha = \frac{F_1}{mg_\perp},$$

$$g_\perp = \frac{V^2}{R},$$

and α is the coefficient of friction of mass 12 while traversing the interior of tube 10, and $F_{||}$ is the frictional force experienced by mass 12 while it is accelerated in tube 10. The foregoing assumes $(r/R)^2$ is zero, a valid assumption for most situations because (R/r)>10. It also assumes that the relative phase angle (ψ−φ) is equal to 90°, where ψ is the phase angle of crank arms 24 relative to the horizontal coordinate axis, and φ the phase angle of projectile 12 relative to the horizontal coordinate axis, in its motion around the track as shown in FIG. 2.

The ratio of the force resulting from the coriolis wave travelling with speed (R/r)v to the frictional drag force $F_{||}$ on mass 12 is $$\frac{r}{R\alpha}$$

for the optimum phasing condition of ψ−φ=90°. A small friction coefficient, α, is desirable so α<r/R<<1. It can also be shown that the velocity of mass 12 increases each cycle it traverses tube 10 by approximately 2πv for the case that the friction is negligible.

For more general phasing cases it can be shown that the motion of mass 12 around track 10 is given by the equation $$mR\ddot{\phi}\sim mr\dot{\psi}^2 \sin(\psi-\phi)-F_{||},$$

where the approximation assumes $(r/R)^2$ is negligible. This equation applies for general cases in which the relative phase angle $(\psi-\phi)$ between the crank arms and the projectile location, as shown in FIG. 2, is not necessarily equal to the optimum value of 90°.

Figure 3A:
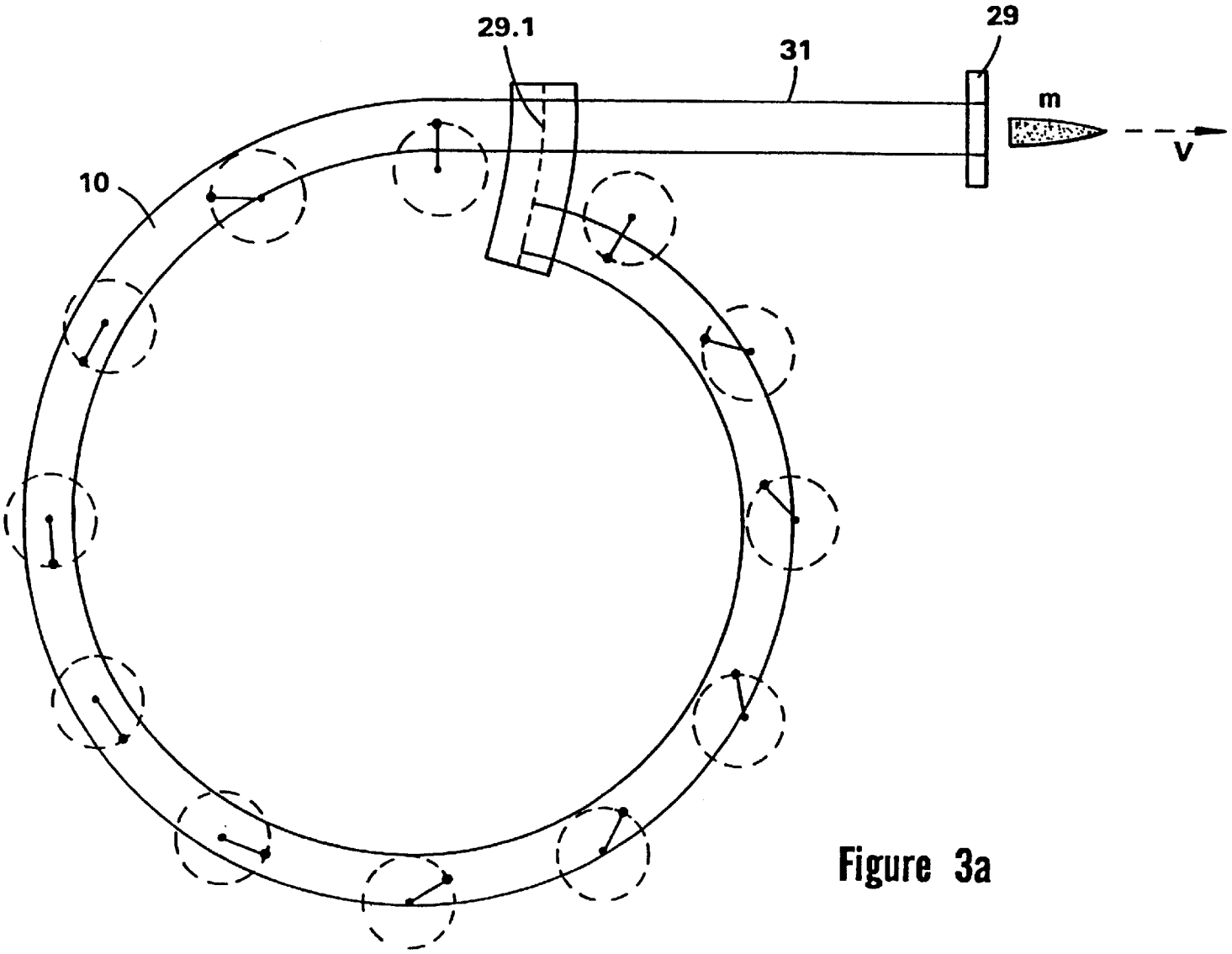
FIG. 3*a* is a schematic view of one embodiment of a structure (included in the device illustrated in FIG. 2) for ejecting the mass from the normal circular track it is traversing.

After mass 12 has reached a desired velocity in tube 10, the shape of the track is changed to modify the trajectory of mass 12 so the track has a curvature that is no longer circular and the mass can pass into an exit tube section. To this end, when the velocity of mass 12 is sensed by position detectors 20.1–20.4 and computer 18 to have reached a predetermined value and the mass has just passed sliding seal 29.1, the computer controls the speeds of motors 20.1–20.12 to displace tube 10 to smoothly modify the radius of curvature of the track formed by the tube as illustrated in FIG. 3*a*. The exit section of tube 10 slides radially out along sliding seal 29.1 so that it becomes connected to a straight exit tube section 31. The motors are programmed so that on the approach side to the sliding seal, the radius of curvature of the accelerator tube smoothly increases to approximately infinity, i.e., it straightens out, so that the centrifugal force experienced by the projectile as it approaches the exit tube is slowly relieved and only a small jerk, $\ddot{V}$,is experienced by the projectile on approach to the straight exit tube section. Door 29 is opened to allow passage of the high velocity mass out of the device. Exit tube 31 is at sub-atmospheric pressure and includes magnetic levitation mechanism so relatively low frictional forces are still maintained between the mass and guide tube.

Figure 3B:
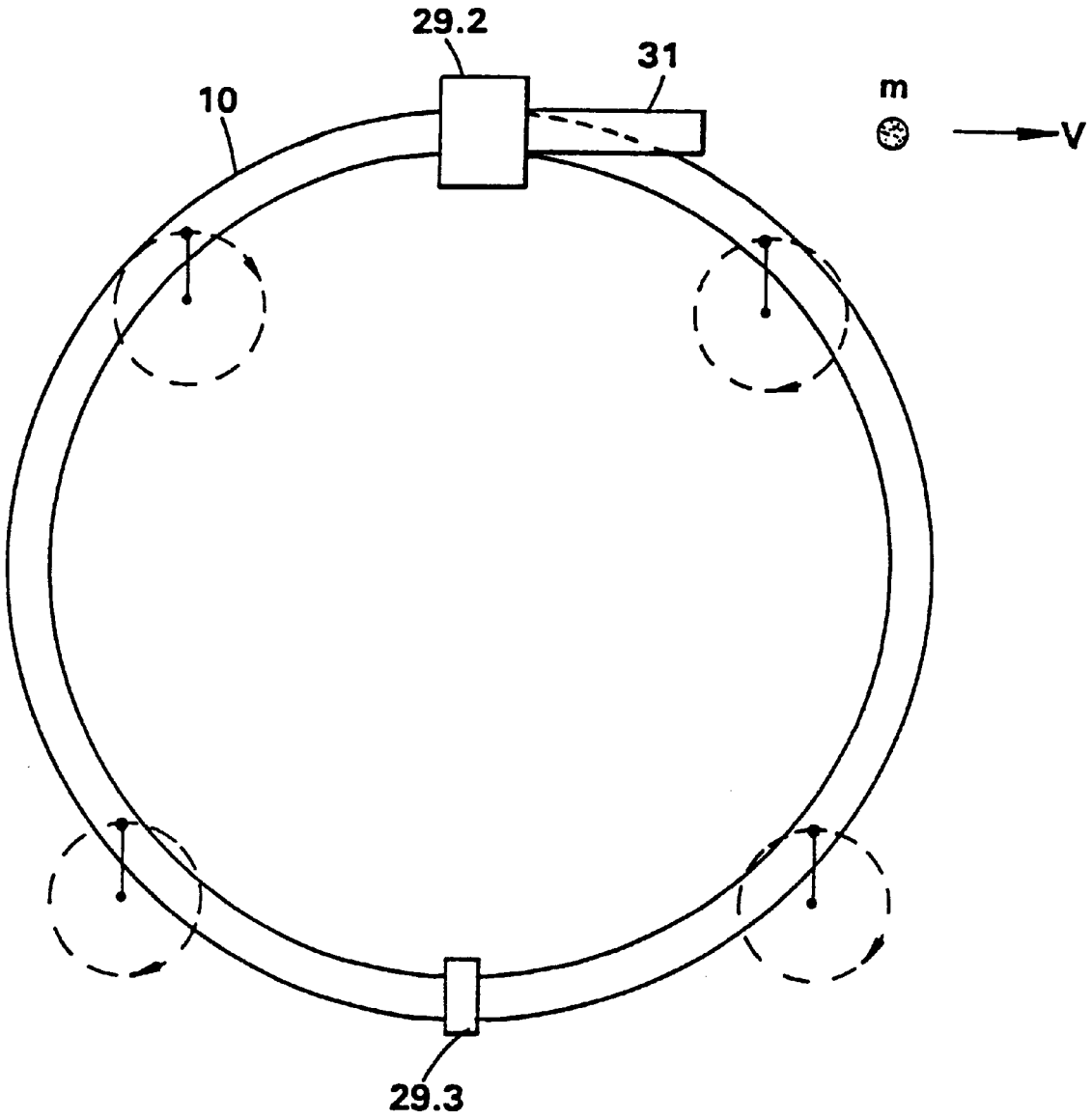
FIG. 3*b* is a schematic view of a second embodiment for ejecting the mass from the normal circular track it is traversing.

FIG. 3*b* is a schematic diagram of a second embodiment for ejecting the projectile from the device that is particularly suited for smaller systems. In FIG. 3*b* swivel 29.3 is located at a diametrically opposite position from tube displacement unit 29.2. Displacement unit 29.2, when activated, displaces tube 10 to the left side of unit 29.2 (as viewed in FIG. 3*b*) up and out of the plane of initially circular accelerator tube 10 to connect tube 10 to exit tube 31. Such displacement causes a semi-circular section of tube 10 on the mass approach side if unit 29.2 in FIG. 3*b* to tilt and rotate through a small angle in swivel 29.3. When displacement unit 29.2 is activated the mass passes around tube 10 and exits through tube 31.

It is to be understood that the principles described in connection with FIG. 2 can also be used to decelerate a mass. Deceleration is provided by operating motors 20.1–20.12 in a manner opposite from that for accelerating mass 12. To decelerate a mass, the motion of rigid guide tube 10 is controlled by computer 18 monotonically decreasing the speeds of shaft 22 of motors 20.1–20.12 so the portion of the guide tube where the mass is sensed to be located is moved outwardly along a local radius of curvature of the track being traversed by the decelerated mass and that the portion of the track diametrically opposed from the portion of the track where mass 12 is located is moved inwardly toward axis 14.

Figure 4:
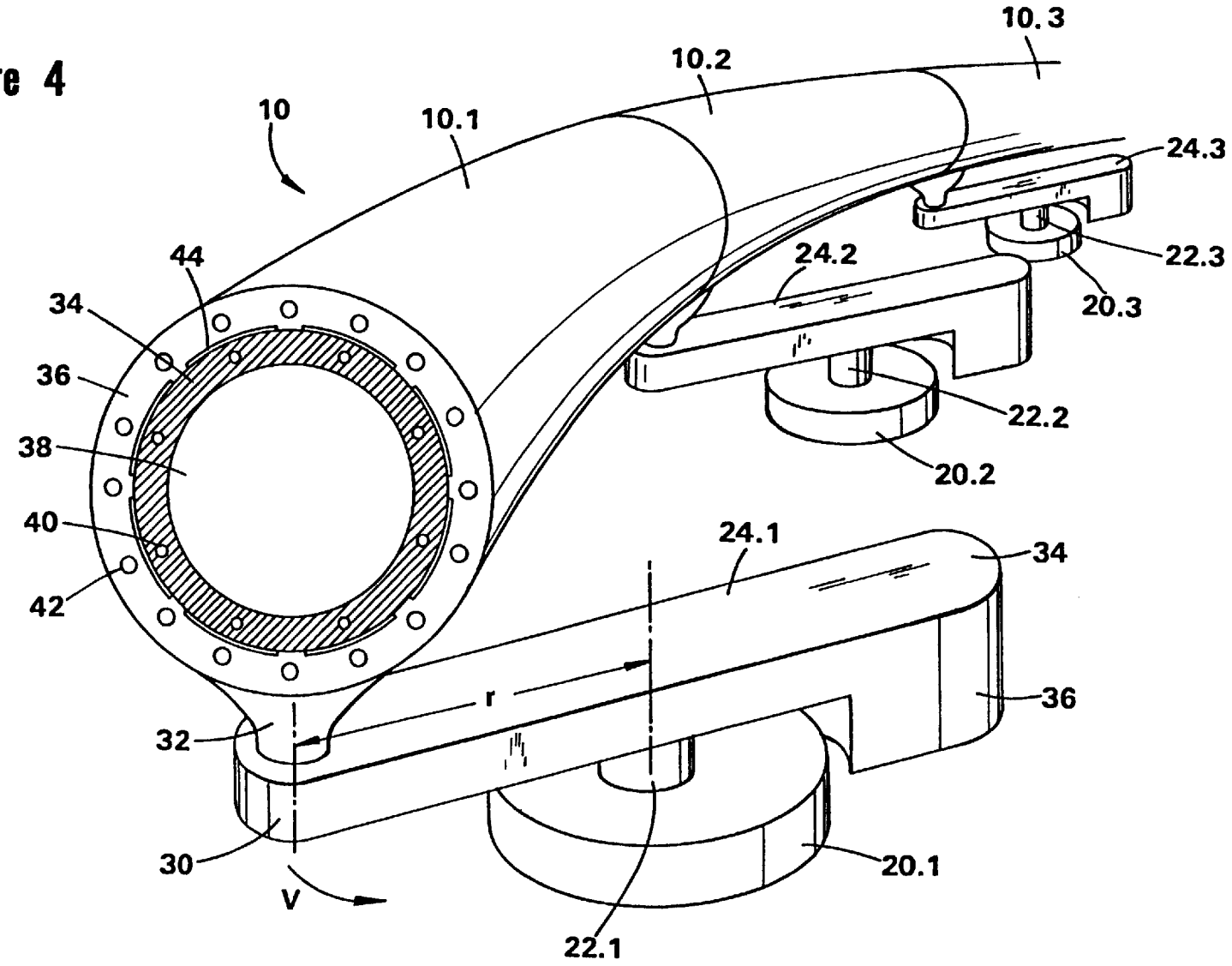
FIG. 4 is a perspective view of a portion of the structure illustrated in FIG. 2 in accordance with one embodiment of the invention.

A preferred embodiment of guide tube 10 and the drive mechanism thereof is illustrated in FIG. 4 wherein track 10 is illustrated as being carried by crank arms 24.1, 24.2 and 24.3, in turn driven by shafts 22.1, 22.2 and 22.3 which are driven by motors 20.1, 20.2 and 20.3. Each of crank arms 24 has a first end 30 fixedly connected to guide tube 10 by stanchion 32 that can rotate in crank arm 24.1. Counterweights 36, mounted on an end of each of crank arms 24 opposite from stanchions 32, have a position and mass such that they balance the mass of the tube and stanchions attached at the other end of the crank arms 24 so that relatively low forces are exerted on shaft 22 in a direction perpendicular to shafts 22.

In the embodiment illustrated in FIG. 4, rigid tube 10 includes multiple sections 10.1, 10.2, 10.3 etc. which are fixedly attached together to form a vacuum seal. A stanchion 32 is mounted at one end of each of tube sections 10.1, 10.2, 10.3 etc. Each of sections 10.1, 10.2, 10.3 etc, includes an inner liner 34 made of a nonmagnetic material having high electrical and thermal conductivity, such as copper or aluminum. Each of liners 34 is curved between opposite ends of its respective tube section so that all of the tube sections 10.1, 10.2, 10.3 etc., when attached together, form a circle having radius R to the center of each liner 34. Surrounding pipe 34 is sleeve 36, preferably made of steel or a strong lightweight composite material to provide strength. Within liner 34 is bore 38, maintained at very low pressure so that mass or projectile, 12 which traverses the bore, encounters negligible frictional forces due to contact with air molecules. Liner 34 and sleeve 36 respectively include numerous cooling channels 40 and 42 in which cryogenic fluids are circulated. Sleeve 36 includes numerous longitudinally extending grooves 44 in which a vacuum is maintained on the inner periphery thereof, adjacent the outer periphery of liner 34. Grooves 44 provide a barrier to thermal conduction for devices requiring an extremely low temperature, below that of liquid nitrogen, for liner 34.

To minimize frictional forces between mass 12 and the wall of bore 38, defined by the inner periphery of liner 34, the mass is magnetically levitated away from the bore wall. To this end, mass 12 includes, in the embodiment of FIG. 4, either a permanent magnet or a DC electromagnet that produces magnetic field flux that is compressed between the projectile and liner 34 and serves to levitate the projectile away from the inner boundary of liner 34. Liner 34 behaves like a diamagnetic medium which excludes the magnetic flux that originates from mass 12 as it sweeps over the high conductivity metal tube liner. Frictional forces between mass 12 and liner 34 result principally from the ohmic resistance to eddy currents in liner 34; the frictional forces decrease in proportion to $V^{-1/2}$ for values of V more than several tens of m/sec. The frictional forces between mass 12 and liners 34 are reduced since the surface of liner 34 defining the wall of bore 38 is cooled by the fluid flowing through channels 40 and 42 to increase the liner electrical conductivity.

There are two basic conditions to satisfy for a useful design of the accelerator structure of FIG. 4 to accelerate a mass having a large value to high speed. First, the centrifugal force $mg_{\perp}$ (the product of the mass of mass 12 times the centrifugal acceleration thereof) that pushes the mass against the outer wall of bore 38 is balanced by the magnetic levitation force $F_{lev}$ that supports the mass at an appropriate distance away from the surface of bore 38. Second, the electromagnetic drag coefficient $\alpha_{EM}$ due to dissipation of eddy currents induced by the levitation fields is sufficiently small that the accelerating coriolis force exceeds the electromagnetic drag. These conditions can be mathematically represented as:

$$F_{lev}=mg_{\perp},$$

and $$1>>r/R>\alpha_{EM}.$$

Since r/R is much less than 1, the maximum rotary speed of the hula hoop type motion of tube 10 can be relatively small (for example a few tens of meters per second), which is advantageous for mechanical reasons, while still providing a high coriolis wave speed (R/r)v.

Figure 5:
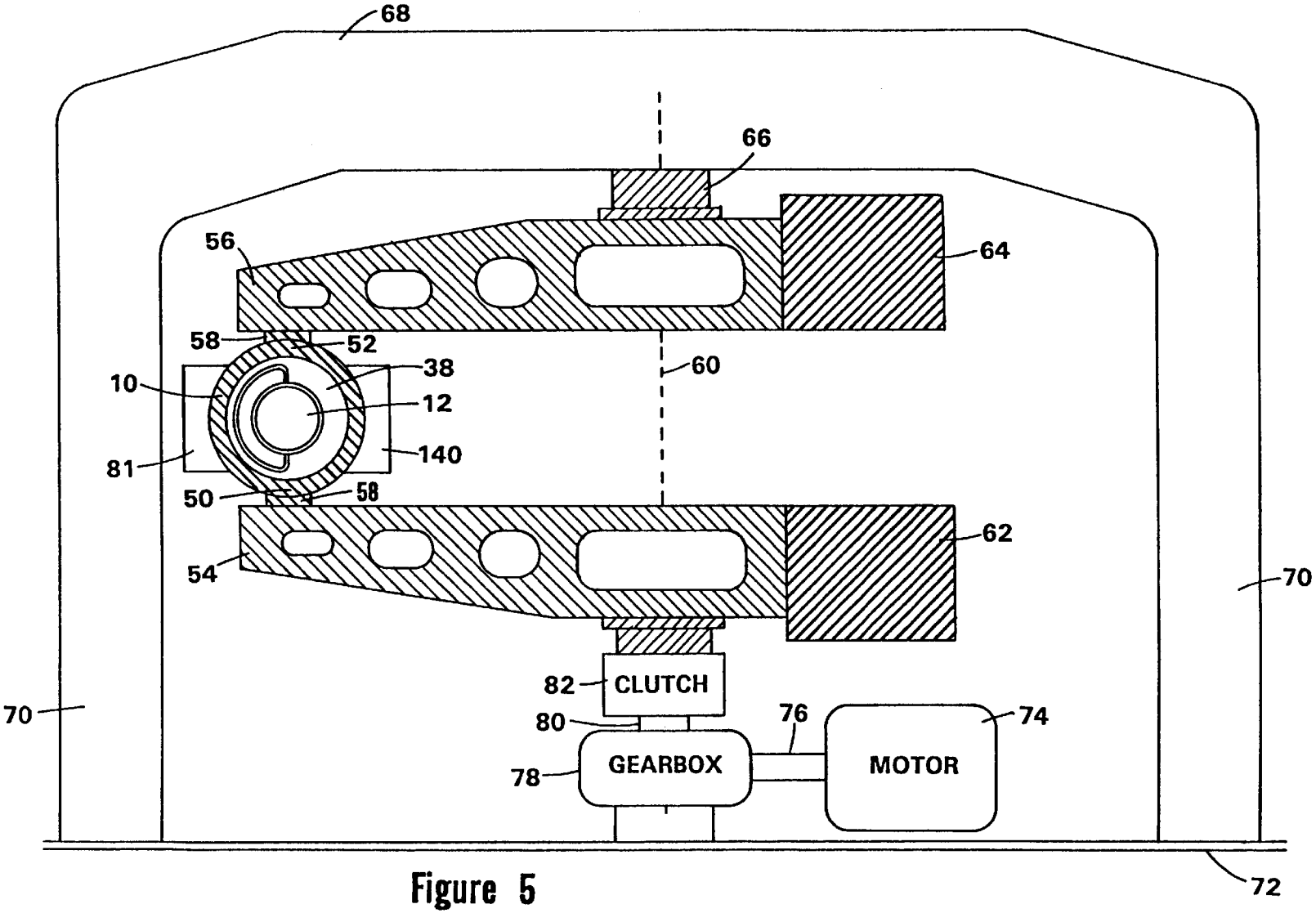
FIG. 5 is a cross sectional view of a second embodiment of a portion of the apparatus illustrated in FIG. 2.

In another preferred construction of the invention, as illustrated in FIG. 5, diametrically opposed vertical portions 50 and 52 of tube 10 are supported by radially extending horizontal arms 54 and 56, connected to the tube by rotary stubs 58. Arms 54 and 56 (corresponding to one of cranks 24) rotate about axis 60 (corresponding to the axes of shafts 22), and are respectively provided with counterweights 62 and 64 on opposite sides of axis 60 relative to tube 10. Arm 56 is connected by bearing 66 to massive arch 68 including vertically extending legs 70 that are fixedly secured to solid support structure 72. Support structure 72 carries motor 74 which drives arm 54 about axis 60 via gear box shaft 76, gear box 78, shaft 80 and clutch 82. Gear box 78 is fixedly mounted on support structure 72. Counterweights 62 and 64 have the same position and weight relative to axis 60 to provide dynamic balancing of the entire rotating mass.

For clarity, rotor arms 54 and 56 are illustrated in FIG. 5 90° from the position they would normally occupy when mass 12 is in the position shown, i.e., arms 54 and 56 would be parallel to tube 10 if mass 12 were in the position shown. Clutch 82 prevents high impulsive loads from mass 12 from passing through gear box 78. The speed of motor 74 is controlled by computer 18 to accelerate tube 10 and mass 12 and to make up for slippage of clutch 82 that may occur as the projectile passes around tube 10 in the vicinity of the rotary drive system shown.

A vacuum pump 81 is mounted on sling tube 10 in FIG. 5. A microwave power injection unit 140 is also mounted on tube 10 to injet power to maintain the energy stored in the power supply carried by the passing mass 12 as needed to maintain magnetic levitation of the mass.

Figure 6:
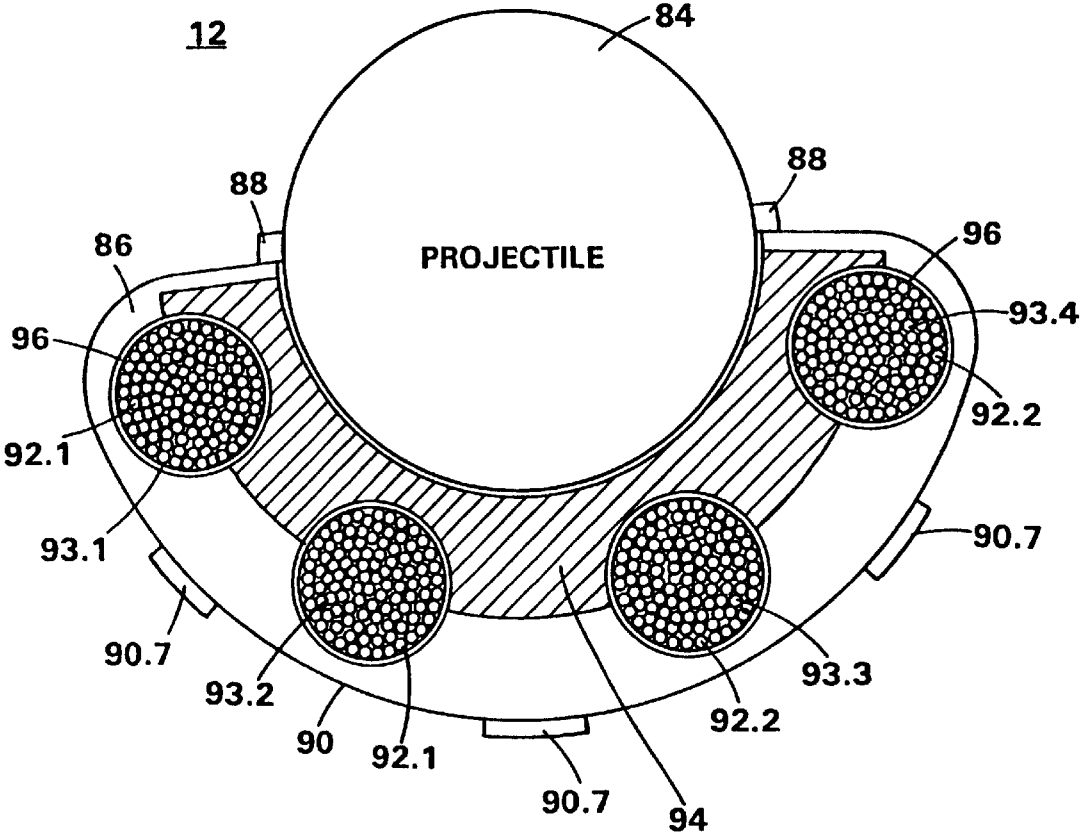
FIG. 6 is a cross sectional view of a projectile or mass to be employed in the embodiment of FIG. 5.

A preferred configuration of mass 12, particularly adapted for the structure of FIG. 5, is illustrated in cross section in FIG. 6. Mass 12 includes projectile 84, having a circular cross section, and projectile-carrying sled 86. Projectile 84 is initially fixedly connected to sled 86 by latches 88. Projectile 84 is released from sled 86 by opening latches 88 after mass 12 has been released from tube 10 and while the mass is in transition into straight escape or exit tube 31. After projectile 84 is released from sled 86, the sled is directed into a tube, thence into the type of structure illustrated in FIG. 2, which is operated in a deceleration mode. The structure of FIG. 2 is operated in the deceleration mode by operating motors 20.1–20.12 so that when sled 86 is at a particular location in tube 10, the tube is moved outwardly along the local radius of curvature of the track or path where the sled is located.

Sled 86 includes an exterior arcuate surface 90 remote from projectile 84 and adjacent the outer portion of bore 38. Surface 90 is a sector of a circle having a radius slightly less than the radius of bore 38. The curvature of arcuate surface 90 matches that of the wall portion of bore 38 remote from axis 14, i.e. the outer wall of the bore.

Sled 86 includes rollers 90.7, each having an axial shaft recessed below surface 90. Rollers 90.7 provide a low friction coefficient for the low velocity start-up of the mass prior to magnetic levitation. The initial velocity of the mass can be derived from the accelerating motion of tube 10 or from an electric motor (not shown) carried on the mass that drives rollers 90.7. Once the mass has reached a suitable speed, for example several tens of m/sec or more for large hoop radius accelerators, magnetic levitation forces become effective to levitate the mass above the inner wall of tube 10. After sled 86 has been levitated, rollers 90.7 no longer contact the inner surface of tube 10.

Sled 86 carries coil assemblies 92.1 and 92.2 and DC power supply 94. Coil assembly 92.1 includes two segments 93.1 and 93.2 each including wires extending linearly in the same direction as the longitudinal axes of tubes 10.1, 10.2, 10.3 etc. Assemblies 92.1 and 92.2 include electric wires that extend in the same direction as the axes of tube sections 10.1, 10.2, 10.3 etc. The wires of coil assembly 92.1 are supplies with DC current by power supply 94 and are arranged so the current flows in opposite directions in the wires of segments 93.1 and 93.2. The wires of coil assembly 92.2 are also supplies with DC current by power supply 94 and are arranged so the current flows in opposite directions in the wires of segments 93.3 and 93.4. The currents in the wires of coil assemblies 93.2 and 93.4. The currents in the wires of coil assemblies 93.2 and 93.3 flow in opposite directions. Thereby, there is an additive effect from the DC magnetic fluxes resulting from current flowing in the wires of segments 93.1, 93.2, 93.3 and 93.4.

Coil assemblies 92.1 and 92.2 are located in cryogenic containers 96, including a pair of tubes running in the same general direction as the longitudinal axes of tube sections 10.1, 10.2, 10.3 etc. Coil assembly 92 is pre-cooled by supplying liquid nitrogen to the interior of container 96 prior to initial activation of motors 20.1–20.12. The wires of coil assembly 92 may be normal copper or aluminum wires or superconducting lines to reduce the energy requirements of power supply 94 and microwave recharging system 140.

The magnetic flux resulting from energization of coil assemblies 92.1 and 92.2 levitates projectile 84 and sled 86 away from the wall of bore 38. Typically, the magnetic field needed to levitate mass 12 has a magnitude in excess of 10 Tesla to provide in excess of 400 bars of support pressure. In the embodiment of FIGS. 5 and 6, coil assemblies 92.1 and 92.2 are located on mass 12, instead of in tube 10 to obviate the requirement for a magnetic structure on each of moving tubes 10.1, 10.2, 10.3 etc.

Figure 7:
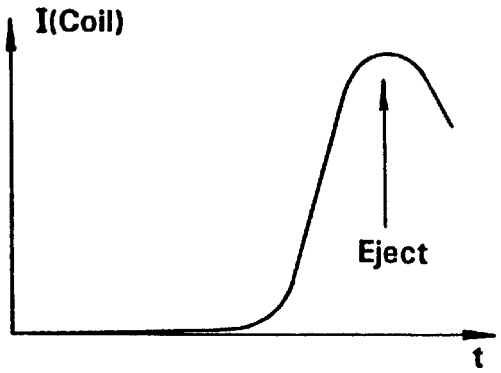
FIG. 7 is a plot of current vs. time of current flowing in a coil structure of FIG. 6.

Power supply 94 is programmed to provide a current that increases as a function of time as the velocity of mass 12 increases with time. The current supplied to coil assemblies 92.1 and 92.2 increases as time progresses during acceleration of mass 12 so the levitation separation h between mass 12 and the wall of bore 38 remains approximately constant. The current supplied by power supply 94 to coil assemblies 92.1 and 92.2 initially increases gradually and reaches a peak value when mass 12 is ejected from track 10; the coil current thus has a substantially increases rate of change for a short time prior to mass 12 being ejected from track 10, as illustrated in FIG. 7. After ejection of mass 12 from track 10, the current supplied by power supply 94 to coil assembly 92 decreases.

Because the wires in coil assemblies 92.1 and 92.2 are in cryogenic containers 96, the wires are pre-cooled to a low temperature, to increase the electrical conductivity thereof. The cryogenic atmosphere provided by container 96 continues even after mass 12 has moved away from its initial, home position to minimize ohmic heating during acceleration to enable power supply 94 to be relatively small. The inductive energy stored in the magnetic field resulting from current flowing in the wires of coil assemblies 92.1 and 92.2 which is needed to levitate mass 12 away from the walls of bore 38 is relatively small. For example, a field pressure $B^2/8\pi$ of 1 kilobar corresponds to 100 joules per cubic centimeter, which is small compared to the energy density of a few kilojoules per cubic centimeter that can be stored in batteries forming DC power supply 94.

Sled 86 is preferably made of strong lightweight materials and employs aluminum wires in coil assemblies 92.1 and 92.2. Curved portion 90 of sled 86 has a larger area of magnetic field support pressure than the side area of projectile 84 which is carried by the sled to increase the levitation force which is applied to the projectile. In certain instances, a guide rail (not shown) is provided to damp oscillations of the magnetically levitated sled 86 as the sled and projectile 84 accelerate around tube assembly 10.

For certain tube designs, tube 10 can include an electromagnetic wave guide to transmit power to the magnetic levitation sled, to eliminate or substantially reduce the battery requirements of power supply 94 and thereby reduce the mass of the power supply of sled 86 necessary to levitate mass 12 away from the wall of bore 38. Typically, the kinetic energy of tube 10 and its associated structure, including rotors and counterweights, in less than the kinetic energy of mass 12. This inequality appears to apply for a wide range of structures.

To accelerate a very large mass, such as a projectile launched into space, costs are reduced by retaining magnetic levitation sled 86 for re-use and only projectile 84 is ejected from the mass launcher.

Figure 8:
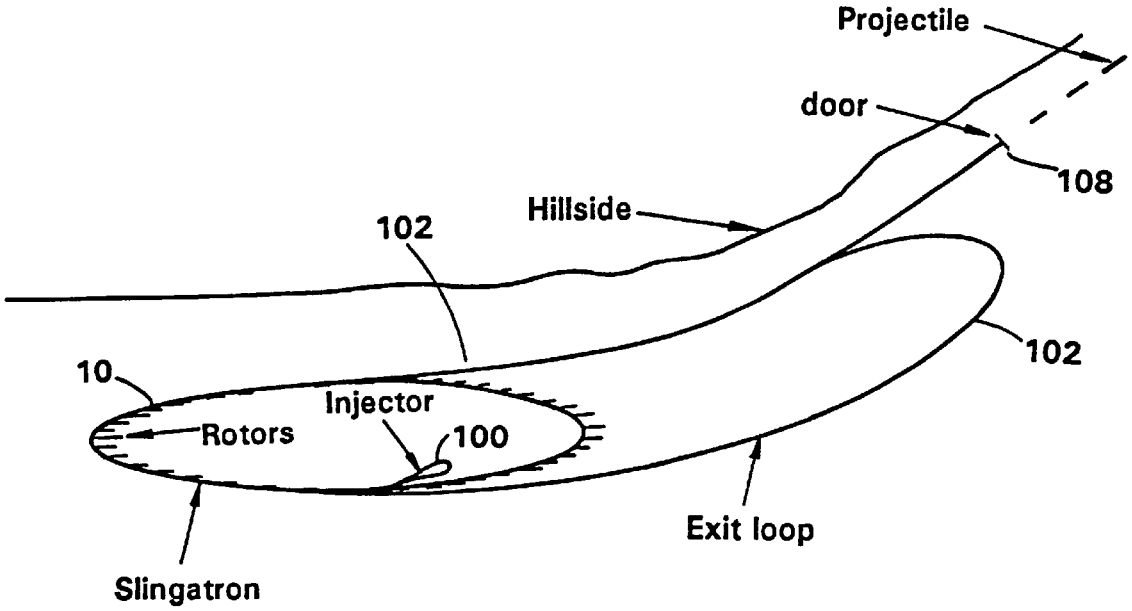
FIG. 8 is a schematic diagram of a complete launch facility based on the present invention.

A structure utilizing the principles of the present invention for launching projectile 84 into space is schematically illustrated in FIG. 8. Accelerator tube 10, as illustrated in FIGS. 2 and 5, is located at the bottom of a hill, with tube axis 14 vertically oriented. Interior bore 38 of tube 10 and all elements in fluid flow relation with it are maintained at sub-atmospheric pressure by pumps 81. Mass 12, including projectile 84 and sled 86, is injected into the tube 10 by injector 100, which can be a small diameter version of the structure illustrated in FIG. 5. After mass 10, including projectile 84 and sled 86, has been accelerated many times around tube 10 and has reached a desired velocity, motors 20.1–20.12 driving tube 10 change the motion of the tube as described in connection with FIG. 3*a*, and the mass is ejected from circular tube 10 into tube 102, having a sliding vacuum seal 29.1.

Tube 102, extending tangentially from circular tube 10, includes metallic walls to maintain the levitated status of mass 12 and is exhausted to a vacuum by pumps located along tube 102. The entrance of tube 102 has a circular cross section with the same cross-sectional area as circular tube 10. The cross-sectional shape and area of tube 102 change gradually along the length of the tube as distance increases from the tube entrance so the tube cross-section where the mass is located conforms with the cross-sectional shape of projectile 84 and sled 86. The conforming cross-section slowly rotates through 180° about the axis of tube 102 to guide the projectile and sled so they rotate to an orientation which is the reverse of the orientation they had no entering tube 102. Once projectile 84 and sled 86 are in this position, latches 88 are opened and projectile 84 is released from sled 86. Projectile 84 then continues along a straight section of tube 104 that branches tangentially from conformed tube 102 and exits door 108 into the atmosphere. Conformal tube 102 guides sled 86 along a curved path away from straight tube section 104 and guides the sled so it is rotated 180 ° about the axis of tube 102. Sled 86 is thereby restored to its correct orientation for re-insertion into tube 10 of the accelerator. After this maneuver sled 86 continues along exit loop 102 and is reinserted into tube 10.

When sled 86 enters circular tube 10, the circular tube is driven by motors 20.1–20.12 so that the section of the circular tube where the exit of tube 102 is located enables sled 86 to continue moving at approximately the same speed it had in tube 102. Once sled 86 has entered tube 10, the sled is decelerated by activating motors 20.1–20.12 so that the portion of the tube traversed by sled 86 is moved outwardly along the local radius of curvature of the track defined by the outer portion of the wall of bore 38.

While magnetic levitation is preferably provided by magnetic fields produced on sled 86, the magnetic levitation field can also be provided by magnetic fields originating in tube sections 10.1, 10.2, 10.3 etc. The levitated magnetic fields originating in tube sections 10.1, 10.2, 10.3 etc. can be produced by permanent magnets, as schematically illustrated in FIG. 9 or by electromagnets energized by DC currents, as illustrated in FIG. 10.

Figure 9:
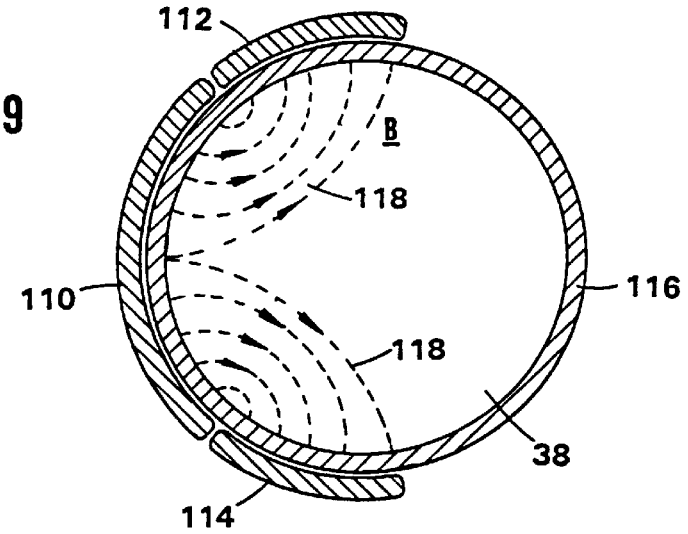
FIG. 9 is a schematic cross sectional view of a tube that can be used in the apparatus of FIG. 2, wherein the tube includes permanent magnets for levitating a mass.
Figure 10:
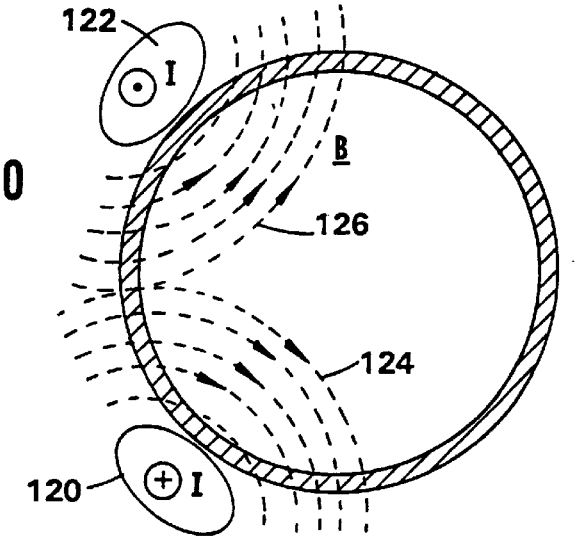
FIG. 10 is a schematic cross sectional view of a tube that can be used in the apparatus of FIG. 2, wherein the tube includes electro-magnets for levitating a mass.

As illustrated in the cross sectional view of FIG. 9, tube section 10.1 has radially polarized permanent magnets 110, 112 and 114 mounted on the portion of the tube remote from axis 14, i.e., on the outer wall portion of the high electrical conductivity liner of tube section 10.1. Inner wall 116 of tube section 10.1 is non-magnetic material of high electrical conductivity, so the magnetic fields from permanent magnets 110, 112 and 114 diffusely penetrate the wall and extend to the interior bore of the tube where mass 12 is located. Each of magnets 110, 112 and 114 extends longitudinally along the length of tube section 10.1 and has an interior curved section matching and abutting the outer portion of wall 116. Permanent magnet 110 has an arcuate length around the circumference of circular tube section 10.1 of 90°, with the center of the magnet between its opposite ends being in the horizontal plane along a radial line at right angles to axis 14. Each of magnets 112 and 114 has an arcuate extent of approximately 45°, such that the ends of these magnets remote from magnet 110 are approximately vertically aligned. Magnet 110 is radially polarized so the north face of the magnet is adjacent the outside portion of tube wall 116 and the south pole of the magnet is somewhat remote from wall 116. Conversely, the inner faces of magnets 112 and 114 abutting wall 116 have south polarizations, while the faces of these permanent magnets remote from wall 116 have north poles.

Permanent magnets 110, 112 and 114 on tube section 10.1 produce magnetic flux lines 118 inside tube section 10.1 when mass 12 is traversing a portion of tube 10 different from tube section 10.1. Magnetic field lines 118 originate from the north face of magnet 110, extend into interior bore 38 of tube section 10.1 and terminate on the south poles of magnets 112 and 114. The magnetic lines of flux originating from the center portion of permanent magnet 110 terminate on the portions of magnets 112 and 114 which generally lie in the vertical plane. The flux lines originating toward the ends of permanent magnet 110 terminate on adjacent portions of permanent magnets 112 and 114, while the flux lines originating from the portion of permanent magnet 110 between the central portion and the upper end of the permanent magnet end on intermediate portions of magnet 112; conversely, flux lines originating between the center portion of permanent magnet 110 and the lower end of the permanent magnet terminate on intermediate portion of magnet 114.

The flux direction in one half of tube sections 10.1, 10.2, 10.3 etc, is as described in connection with FIG. 9. The remaining tube sections have flux lines therein reversed from the situation described in connection with FIG. 9. To this end, the large permanent magnets of these other tube sections have north and south poles thereof reversed from permanent magnet 110 so the south poles thereof are proximate wall 116 while the north poles are remote from the tube wall. Conversely, the north and south poles of the smaller permanent magnets of these remaining sections are reversed from the situation illustrated in FIG. 9 for permanent magnets 112 and 114 so that the smaller permanent magnets of these tube sections have north poles adjacent wall 116 and south poles remote from the tube wall.

There can be one or more flux reversals, which are provided to prevent magnetic flux from penetrating through a liner on the levitated mass 12 being accelerated by tube 10. The permanent magnets are arranged on the tube sections, 10.1, 10.2, 10.3 etc, such that for the circumference around tube 10, the sum total of the magnetic fluxes originating from magnets 110 and terminating on magnets 112 and 114 equals the magnetic fluxes originating from magnets 112 and 114 and terminating on magnets 110.

Magnetic fields equivalent to those produced by permanent magnets 110, 112 and 114 can also be produced by electromagnet coils 120 and 122, FIG. 10. Each of coils 120 and 122 has an elliptical cross section and is located in proximity to wall 116 at a position adjacent the portion of the wall remote from axis 14 and approximately 45° form the horizontal. Each of coils 120 and 122 extends longitudinally along the length of each of tube sections 10.1, 10.2, 10.3 etc. and is integrally mounted on each tube section. Opposite polarity DC currents are supplied to coils 120 and 122 from suitable DC current sources (not shown). In the illustrated example, the current in coil 120 flows away from out of the viewer while the current in coil 122 flows out of the coil toward the viewer.

The currents flowing in coils 120 and 122 respectively cause magnetic flux lines 124 and 126 to be produced. Flux lines 124 and 126 have basically the same pattern inside the bore of each of tube sections 10.1, 10.2, 10.3 as flux lines 118, FIG. 9. The direction of current flow in coils 120 and 122 of different tube sections 10.1, 10.2, 10.3 etc. is reversed, based on the same criteria as described supra for the reversal of flux direction of flux lines 118.

Figure 11:
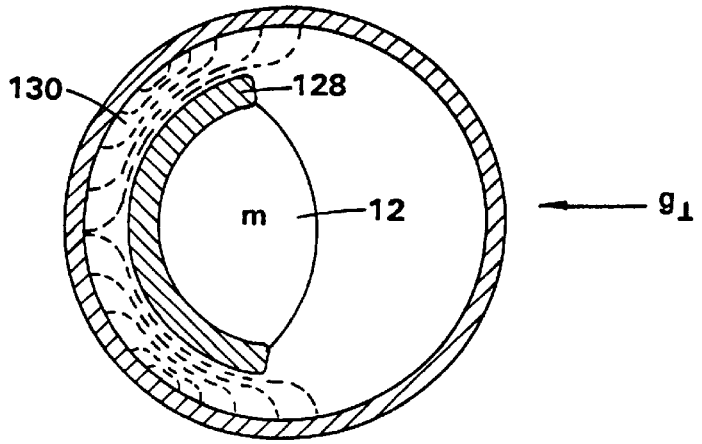
FIG. 11 is a schematic drawing of the structure illustrated in FIG. 9 or 10 with a mass therein.

As mass 12 is accelerated in tube 10, the mass has a tendency to be urged against the portion of wall 116 remote from axis 14, as illustrated in FIG. 11. To provide the magnetic levitation effect, mass 12 is provided with non-magnetic liner 128 having high electric conductivity, preferably made of aluminum because of its light weight and cooled to increase its electrical conductivity. Liner 128 has an arcuate shape, in cross section, and extends in the same direction as each of tube sections 10.1, 10.2, 10.3 etc. Liner 128 has a shape conforming with a sector of a circle having a diameter somewhat less than the inner diameter of wall 116.

As mass 12 circles around tube 10 the mass is pushed toward the wall of tube 116 remote from axis 14 by centrifugal force $mg_1$. The centrifugal force compresses the magnetic flux lines 118 in the embodiment of FIG. 9 or the magnetic flux lines 124 and 126 in the embodiment of FIG. 10 to produce compressed magnetic flux lines 130, FIG. 11. Compressed magnetic flux lines 130 are produced in the tube section being traversed by mass 12 to increase the magnetic pressure exerted on liner 128 to levitate mass 12.

The structures of FIGS. 9–11 are advantageous relative to the structure of FIG. 6 because they do not require mass 12 to carry a power supply or coils. However, the structures of FIGS. 9–11 have the disadvantage of causing a greater amount of heat to be dissipated and energy to be generated to produce the levitating effect.

Figure 12:
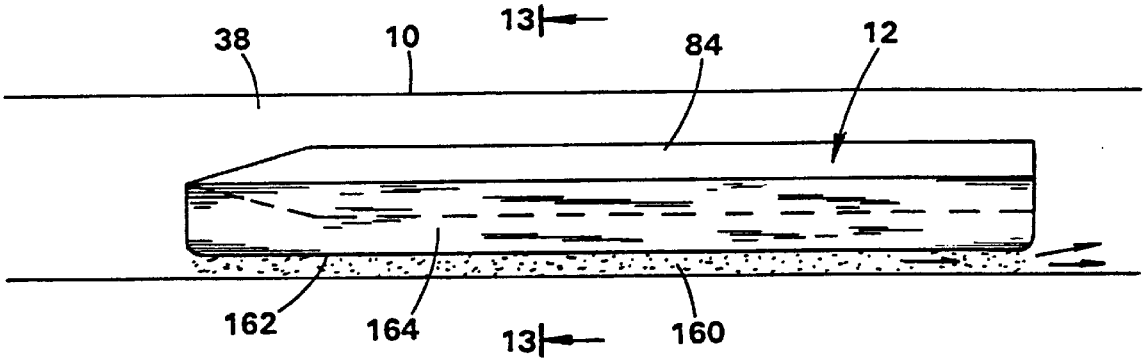
FIG. 12 is a schematic drawing of a gas cushion for levitating a sled carrying a projectile.
Figure 13:
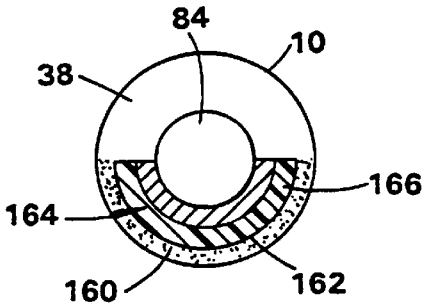
FIG. 13 is a sectional view taken through the lines 13—13, FIG. 12.

A low friction coefficient $\alpha$, satisfying $\alpha < r \sin(\psi - \phi)/R$, can also be attained by providing a gas bearing including a thin cushion 160 of gas between bore 30 of tube 10 and underside 162 of sled 164, that carries projectile 84, as shown schematically in FIGS. 12 and 13. In the embodiment of FIG. 12, gas cushion 160 is provided by continuously evaporating material from a thick layer 166 on underside 162 of sled 164. Layer 166 is preferably formed of a plastic material. Thermal energy is generated in the thin gas cushion 160 by viscous dissipation resulting from high velocity shear that exists in the gas bearing between the stationary gas adjacent tube 10 and the moving gas adjacent layer 162. This thermal energy heats the gas in cushion 160 sufficiently to evaporate material from layer 166 on sled surface 162 facing the outer wall of bore 38 to replenish and maintain the cushion 166 formed by the gas layer. Gas remaining in bore 38 behind mass 12 is continuously pumped out of the bore by vacuum pumps 81, FIG. 5.

While there have been described and illustrated several specific embodiments of the invention, it will be clear that variations in the details of the embodiments specifically illustrated and described may be made without departing from the true spirit and scope of the invention as defined in the appended claims, for example the configuration of track 10 can be changed from circular to elliptical. It is also not necessary in all instances to determine the position of the mass by a sensor arrangement along the track being traversed by the mass. Data collected from (1) previous actual measurements of the mass being accelerated, or (2) theoretical calculations or (3) simulations can be used to determine preprogrammed values for the rotational speed of the motors as a function of time. The preprogrammed values are stored in a memory of computer 18 and can be used to increase the motor speeds during acceleration or to decrease motor speeds during deceleration. The preprogrammed values can possibly be used by themselves in open loop control of the motors. Alternatively the preprogrammed values can possibly be used by themselves in open loop control of the motors. Alternatively the preprogrammed values can be combined with detected values of mass position that are derived from time to time, as necessary for compensation of frictional effects.

I claim:

1. A method of smoothly moving a mass located in a track having a smooth path with an arcuate segment comprising determining the position of the mass in the track, moving the track so a portion of the arcuate segment of the track where the mass is determined to be located is moved substantially radially along a local radius of curvature of the arcuate segment of the track by controlling the movement of the arcuate segment of the track where the mass is determined to be located.

2. The method of claim 1 wherein the position is determined by a sensory arrangement.

3. The method of claim 1 wherein the position is determined from preprogrammed values for the position of the mass as a function of time.

4. The method of claim 1 wherein the track is relatively rigid and a portion of the track approximately diametrically opposed from the portion of the track where the mass is located is moved in the opposite sense along its local radius of curvature from the direction the track is moved where the mass is located.

5. The method of claim 4 wherein the mass is accelerated and the track portion where the mass is located is moved inwardly and the track portion opposite from where the mass is located is moved outwardly.

6. The method of claim 5 further comprising causing the mass to move in a track having lower than atmospheric pressure to provide a path having a low coefficient of friction for the mass traversing the path.

7. The method of claim 5 further comprising levitating the mass as it moves in the track so the mass is removed from any mechanical surfaces associated with the track and path to provide a path having a low coefficient of friction for the mass traversing the path.

8. Apparatus for smoothly moving a mass to a high speed comprising a track having a smooth path with an arcuate segment, a signal source for deriving a signal indicative of the position of the mass relative to the track, the track being arranged and constructed to receive the mass so the mass can traverse the path; a drive responsive to the derived signal for moving the track so a portion of the path arcuate segment where the mass is located is moved substantially radially along a local radius of curvature of the track.

9. The apparatus of claim 8 wherein the signal source includes a sensor for the position of the mass.

10. The apparatus of claim 8 wherein the signal source includes a memory for storing preprogrammed values as a function of operating time.

11. The apparatus of claim 8 wherein the drive for moving the track includes a rotating shaft connected to the track, and a controller for controlling the shaft speed in response to the derived signal.

12. The apparatus of claim 8 wherein the drive for moving the track includes plural rotating shafts distributed about the track, each of the shafts being connected to the track, and a controller for controlling the speeds of the shafts in response to the derived signal.

13. The apparatus of claim 8 wherein the drive for moving the track includes a rotating shaft connected to the track.

14. The apparatus of claim 8 wherein the drive for moving the track includes plural rotating shafts distributed about and connected to the track at different locations.

15. The apparatus of claim 14 further including a crank connected between each rotating shaft and the track.

16. The apparatus of claim 15 wherein each crank includes a counterweight, each rotating shaft being between the connection of the crank to the tack and the counterweight.

17. The apparatus of claim 8 wherein the track is relatively rigid so a portion of the track approximately diametrically opposed from the portion of the track arcuate segment where the mass is located is moved in the opposite sense along its local radius of curvature from the direction the track is moved where the mass is located.

18. The apparatus of claim 8 wherein the mass is accelerated and the drive is activated so the portion of the track arcuate segment where the mass is located is moved inwardly and the track portion opposite from where the mass is located is moved outwardly.

19. The apparatus of claim 8 further comprising means for causing the track to have lower than atmospheric pressure to provide a low friction path for the mass traversing the path.

20. The apparatus of claim 8 further comprising a levitator for levitating the mass as it moves in the track so the mass is removed from any mechanical surfaces associated with the track and path to provide a path having a low coefficient of friction for the mass traversing the path.

21. The apparatus of claim 20 wherein the levitator includes a magnetic source on the mass, the magnetic source including a power supply on the mass, and an electromagnetic field coupler outside the mass for coupling an electromagnetic field to the power supply, the power supply responding to the field so it is at least partially energized by it.

22. The apparatus of claim 21 further including a cooler for cooling the track to reduce frictional effects between the mass and the track caused by eddy currents.

23. A mass adapted to be launched from a guide tube including a smooth path defining a track, the tube having an outer wall portion, the mass comprising a sled having a wall adapted to mate with an outer wall of the guide tube, a projectile releasably attached to the sled, the sled including an energy source connected to a levitating assembly, the energy source energizing the levitating assembly so that the mass is levitated in the guide tube in response to a force derived from the levitating assembly interacting with a surface on the outer wall portion of the guide tube.

* * * * *